United States Patent [19]

Garrocho

[11] 4,418,596

[45] Dec. 6, 1983

[54] PHOTOGRAPHIC PAPER PUNCH

[76] Inventor: Jose M. Garrocho, 7572 Rockhill Rd., Mississauga, Ontario, Canada, L4T 2Z7

[21] Appl. No.: 250,260

[22] Filed: Apr. 2, 1981

[51] Int. Cl.[3] ..... B26F 1/14

[52] U.S. Cl. ..... 83/98; 83/639

[58] Field of Search ..... 83/98, 99, 100, 639

[56] References Cited

U.S. PATENT DOCUMENTS

| | | | |
|---|---|---|---|
| 2,287,168 | 6/1942 | Duncan | 83/689 X |
| 3,196,728 | 7/1965 | Snow | 83/618 |
| 3,232,527 | 2/1966 | Hiser | 83/689 X |
| 3,524,368 | 8/1970 | Goldman | 83/98 |
| 3,722,337 | 3/1973 | Brolund et al. | 83/639 X |
| 3,939,743 | 2/1976 | Coombes | 83/98 |
| 4,096,727 | 6/1978 | Gargaillo | 83/639 X |

FOREIGN PATENT DOCUMENTS

| | | | |
|---|---|---|---|
| 1147947 | 6/1957 | France | 83/639 |

*Primary Examiner*—James M. Meister

*Attorney, Agent, or Firm*—Burke-Robertson, Chadwick & Ritchie

[57] ABSTRACT

A pneumatic punch for paper, and particularly photographic paper. The punch comprises a cylinder having a piston seated within, to be pneumatically driven between upper and lower limits in the cylinder chamber. For this purpose, actuation and retraction air inlet ports are provided through the wall of the cylinder, the ports being separated by the piston against fluid communication within the cylinder chamber between the ports. An elongated guide of constant, circular cross-section is secured centrally to the piston on the side thereof exposed to the air from the retraction air inlet port. An elongated punch of circular cross-section is concentrically secured to the free end of the guide. A central relatively restricted air passageway extends from the actuation air inlet port side of the piston, passing through the piston, guide and punch. A die cooperates with the punch, the die having a body rigidly associated with the cylinder and having a slot of circular cross-section to receive the punch. A space is provided between the punch, when the piston is at its upper limit, and the entrance to the slot of the die to receive and permit passage of paper to be punched. During operation, air pressure from the actuation air inlet port drives the piston to its lower limit as air is passed through the central air passageway of the piston, guide and punch to force a slug of punched paper on through the slot. Such a punch avoids the need for solenoids, often found in prior art punches used for photographic paper and permits smooth operation, ready adjustment and combined pneumatic punching and removal of slugs of paper produced by the punching process.

3 Claims, 5 Drawing Figures

PHOTOGRAPHIC PAPER PUNCH

BACKGROUND OF THE INVENTION

This invention relates to a pneumatic punch for paper, and more particularly to a pneumatic punch useful in punching holes in photographic paper, a step frequently used in modern day photograph printing techniques. In the photograph printing method described and illustrated in U.S. Pat. No. 3,807,855, of Zajack, issued Apr. 30, 1974, a photograph printing machine is provided in which images from negatives are sequentially exposed onto consecutive segments of a roll of photograph print paper. Holes are punched in the print paper to differentiate between individual photographs and between photographs from different rolls of negatives. These holes activate a cutter mechanism at the appropriate location along the roll of print paper, so that the developed photographs may be automatically cut. They are usually located between adjacent prints so that they can be removed by the cutter mechanism.

The punches used in such method and apparatus have usually been heavy, solenoid operated punches. The solenoid, because of its size and the nature of its firing action, causes vibrations in the frame such that the punch step can take place only after or before, and not during, exposure of the photographic paper to the image from the negative. In one such punch, to the free end of the solonoid is attached to plate-like device from which extends a punch of square cross-section. The punch is constrained to move longitudinally in a slot along the outside of the body of a die, with the punch itself being positioned to cooperate with a corresponding rectangular shaped slot in a die button secured to the die body. The slot in the die button extends into an aperture in the die body, beneath which aperture a current of air passes to blow slugs to a location remote from that of the punching operation. Such a prior art device has presented many problems of maintenance. The solenoid has to be replaced from time to time. The alignment of the punch and die button so that the punch will operate properly (which is required for example if the punch becomes out of alignment or a punch or die button is replaced) usually requires the services of an expert since alignment must be extremely precise. Another problem with such prior art device is that the pressure under which the punch is operated cannot be increased or decreased without actually modifying the punch, for example, by replacing the solenoid. It should be noted, with respect to such prior art punches, that they are returned to ready position after each punch, under urging of the spring acting on the punch mechanism.

Another punch device of general background interest is described and illustrated in Daniel Canadian Pat. No. 723,937 issued Dec. 21, 1965.

It is an object of the present invention to provide a pneumatic punch which will be effective for use in punching photographic or other types of paper. It is a further object of the present invention to provide such a punch which can simultaneously provide pneumatic ejection of chips or slugs from the work area. It is a further object of the invention to provide a small, light weight easily manufacturable and servicable punch, which can operate quickly and effectively in association with apparatus for developing photographic prints on strips of photographic paper.

SUMMARY OF THE INVENTION

According to the present invention, a pneumatic punch is provided for paper such as photographic paper, which punch comprises a cylinder having a chamber and a piston seated within the cylinder chamber, the piston to be pneumatically driven between upper and lower limits. For this purpose, actuation and retraction air inlet ports are provided through the wall of the cylinder. The ports are separated by the piston against fluid communication within the cylinder chamber between the ports. An elongated guide of constant, circular cross-section is secured centrally to the piston on the side thereof exposed to the air from the retraction air inlet port. An elongated punch of circular cross-section is concentrically secured to the free end of the guide. A central relatively restricted air passageway extends from the actuation air inlet port side of the piston, passing through the piston, guide and punch. A die cooperates with the punch, the die having a body rigidly associated with the cylinder and centrally receiving the guide, and having a slot of circular cross-section positioned to receive the punch. A space is provided between the punch, when the piston is at its upper limit, and the entrance to the slot of the die to receive and permit passage of paper to be punched. During operation, air pressure from the actuation air inlet port drives the piston to its lower limit and air is passed through the central air passageway of the piston, guide and punch to force a slug of punched paper on through the slot. Such a punch avoids the need for solenoids, often found in prior art punches used for photographic paper and permits smooth operation, ready adjustment and combined pneumatic punching and removal of slugs of paper produced by the punching process.

In a preferred embodiment of the invention, the die body is of cylindrical construction and is concentrically secured to the cylinder. The die body and cylinder may be of integral construction. The die body is preferably provided with a central passageway of circular cross-section extending between the volume of the cylinder chamber communicating with the retraction air inlet and the paper passage space, at least a length of the elongated guide being seated within this passageway for movement between upper and lower limits.

The punch according to the present invention, when properly positioned and secured to the frame of a photograph printing apparatus as described in aforementioned U.S. Pat. No. 3,807,855 of Zajack, operates extremely effectively in punching the necessary holes in the photographic print paper. The advantages of such a punch over known punches are many and significant. The small, relatively light weight piston, guide and punch unit, in relation to the cylinder and die bodies within which they move, results in little or no vibrational movement of the entire punch, unlike previous, solenoid operated devices. As a result, the photograph print paper may be punched at any time during, before or after the exposure operation. Since the system is purely pneumatic for both operation of the punch and removal of the chips or slugs from the work station, a significant simplification of the punch, over prior art punches is achieved, if only since electronic apparatus and circuitry can be avoided in the punch itself. The punch according to the present invention although small, is powerful. Its pressure can be varied without changing the characteristics of the punch, simply by changing the air pressure provided to the device through the activation air inlet port.

Because the device can be constructed of basic circular cross-section, problems of alignment of punch with die are significantly reduced. Alignment problems are further reduced according to the present invention since, because of its basic construction, little movement of the punch is required (i.e. one tenth of an inch or less) during its operative cycle (i.e. from actuation position, movement through the plane of paper into the slot of the die and return to actuation position above the surface of the paper being punched). Indeed, with proper manufacturing, the device according to the present invention may go through its useful life with no adjustment of either punch or die.

Yet another advantage to the present invention lies in the speed of which it can be operated. Since the piston is power-retracted under pressure from the retraction air inlet port, significant increases in speed of operation may be achieved over prior art devices which are spring urged back into operative position.

BRIEF DESCRIPTION OF THE DRAWINGS

Other objects and advantages of the invention will become apparent upon reading the following detailed description and upon referring to the drawings in which.

DETAILED DESCRIPTION OF THE INVENTION

Figure 3:
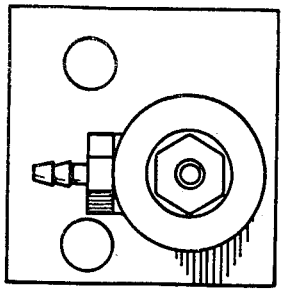
FIG. 3 is a top view of the punch of FIG. 1.

In the drawings, similar features have been given similar reference numerals.

Figure 1:
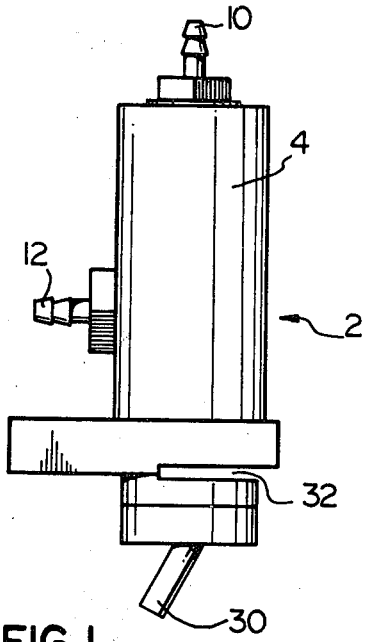
FIG. 1 is a side view, of a paper punch according to the present invention.
Figure 2:
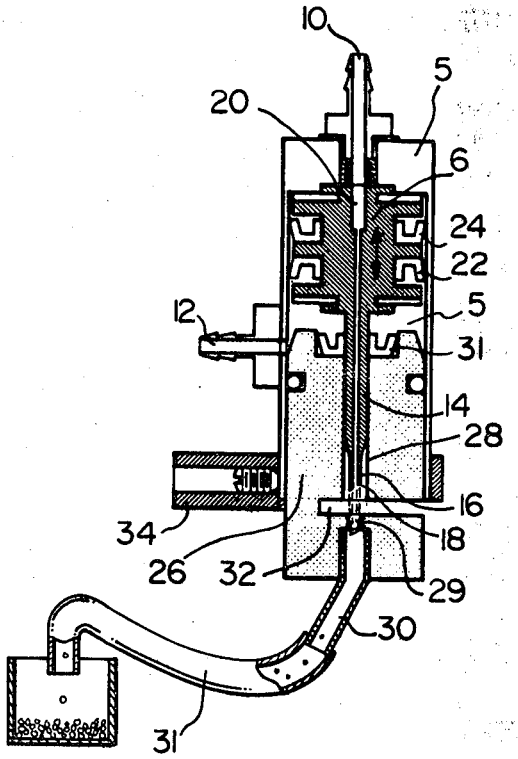
FIG. 2 is a vertical section view of the punch of FIG. 1.
Figure 4:
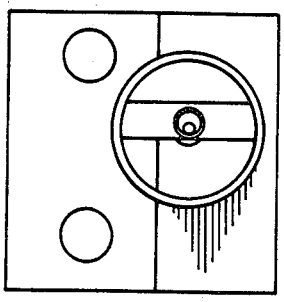
FIG. 4 is a bottom view of the punch of FIG. 1.

Turning now to FIGS. 1 and 2, there is shown a pneumatic paper punch 2 according to the present invention, for use in conjunction with a photographic strip paper printing apparatus of the type described in Zajack U.S. Pat. No. 3,807,855. Punch 2 comprises a cylinder 4 having a chamber 5 within which piston 6 moves between upper and lower limits within that chamber. Piston 6, shown in FIG. 2 is pushed down into its lower, punch position, by means of air pressure supplied through activation air inlet port 10 into the upper part of chamber 5. Air pressure, for example, of 40 p.s.i., may be used to achieve this end. To return piston 6 to its upper, operative position, the air pressure through activation air inlet port 10 is reduced, and air pressure is increased through retraction air inlet port 12 into the lower part of chamber 5. As piston 6 is returned to its upper position, that air pressure is then reduced and the cycle is repeated, as required. While piston 6 is illustrated as being of rigid construction, it may alternatively be of flexible construction, acting as a diaphragm instead of a sliding piston.

An elongated guide 14, of circular cross-sectional construction is secured centrally to the lower surface of piston 6. Punch 16, made of an appropriate hard metal or the like, itself having a circular cross-section and having a free end 18 angled with respect to the plane of the paper to be punched, as illustrated in FIG. 2, is concentrically secured to the free end of guide 14. Piston 6, guide 14 and punch 16 may be made of separate members, or as illustrated, of integral construction. Central air passageway 20 communicate between activation air inlet port 10 and the upper part of chamber 5, through piston 6, guide 14 and punch 16 with the free end 18 of punch 16. The passageway is relatively restricted so as not to impede the punching operation of piston 6 between its upper and lower position by reducing air pressure, yet it is of sufficient size to provide sufficient air pressure during this operation, as will be subsequently explained, to remove punched chips of paper to a remote location. Seals 22 and 24 act to prevent or minimize passage of air between volumes of chamber 5 on opposite sides of piston 6.

Secured to cylinder 4, and similarly of circular cross-section, is die body 26 having a central passageway 28 within which at least a portion of guide 16 is always positioned during up and down movement. Die slot 29 receives the end 18 of punch 16 when piston 6 moves to its lower, punch position. Slugs or chips formed as a result of the punching operation are expelled through tube 30 to a position remote from the work area under urging from compressed air fed to it through air inlet port 10 and air passageway 20. Seal 31 is provided at the entrance to central die passageway 28 to prevent or minimize passage of air from retraction air inlet port 12 in the lower volume of chamber 5 to passageway 28.

Notch 32 is provided to guide paper through die body 26 during the punching operation. An appropriate clamp means 34 is provided for securing the punch in place on the desired apparatus.

It will be understood from FIG. 1 that cylinder 4 and die body 26 may be made of integral construction or, as shown, of separate members.

In operation, at a predetermined moment, compressed air enters activation air inlet port 10, forcing piston 6 to move downwards and punch 16 to protrude through paper in notch 32 and to nest in die slot 29. At the same time, compressed air passes through air passageway 20, blowing the paper slug thus created through tube 30 to a remote convenient location. When this operation is completed, compressed air is applied to retraction air inlet port 12, while activation air inlet port 10 is exhausted to the atmosphere. This action permits piston 6 to return to its upper position.

Figure 5:
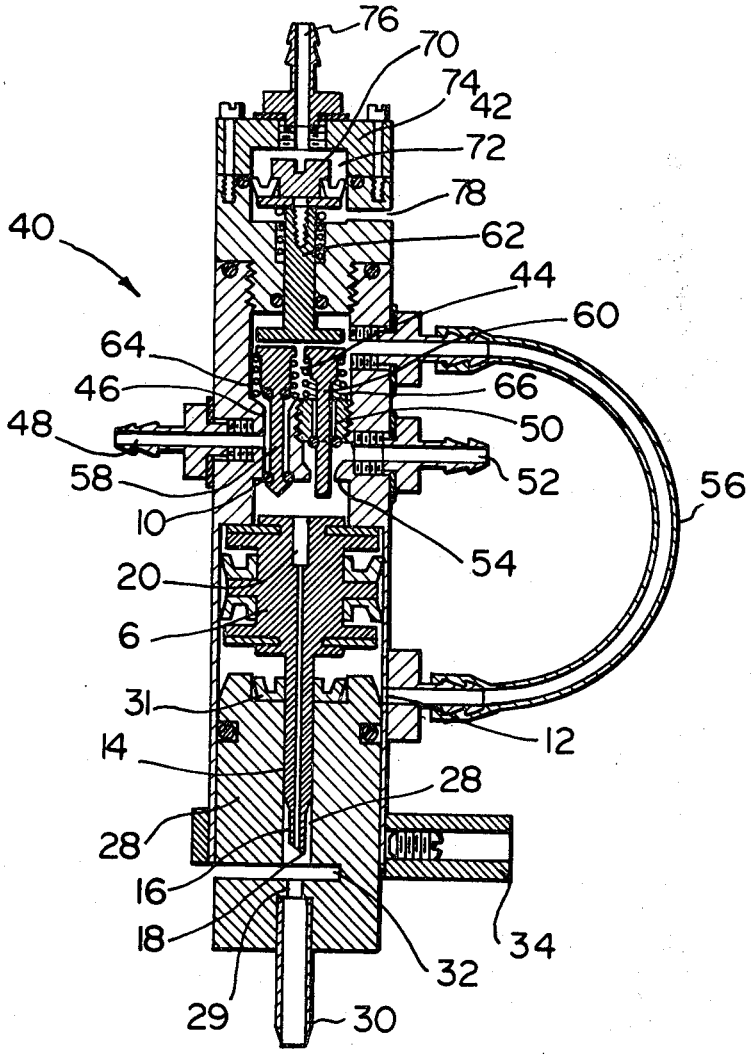
FIG. 5 is a vertical section view of a paper punch according to the present invention associated with an air valve for faster operation.

In FIG. 5 there is shown a further embodiment of the invention in which a air valve is associated with the paper punch of FIG. 1, the effect of which is to permit a higher speed of operation of the punch. The air valve indicated generally by reference numeral 40 in FIG. 5, comprises a body 42 with central chamber 44 of communicating through port 46 with an air pressure inlet 48 and through port 50 with an air pressure exhaust outlet 52. It will be noted that air pressure inlet 48 also communicates directly with activation air inlet port 10 and that there is a further port 54 in the upper part of chamber 5 communicating directly with exhaust outlet 52. As well, tube 56 provides direct communication between air valve chamber 44 and the lower portion of punch chamber 5 through retraction air inlet port 12.

Seal rods 58 and 60, drives downward by piston 62 and upward under urging of springs 64 and 66 respectively, when piston 62 is withdrawn from contact with the upper ends of the seal rods. It will be noted that, in upward positions as illustrated in FIG. 5, seal rod 58 opens port 46 but closes activation air inlet 10, and seal rod 60 closes port 50 but leaves port 54 open. In this position air pressure from inlet 48 passes into chamber 44 and, through tube 56, into the lower part of punch chamber 5, while air pressure in the upper part of chamber 5 is evacuated through exhaust outlet 52. While not shown, it will be readily understood from FIG. 5 that when the seal rods 58 and 60 are in their lower positions, seal rod 58 causes port 46 to be sealed while it opens activation air inlet port 10; seal rod 60 seals port 54 but opens port 50. In this position, air pressure through inlet 48 is fed directly to the upper part of chamber 5, and air pressure is sealed off from chamber 44 and the lower part of chamber 5, these volumes instead being now in open communication with exhaust outlet 52. In this manner, the retraction and activation, respectively, of piston 6 is achieved. Using air valve 40, air pressure inlet 48 should be pressurized at all times while exhaust outlet 52 is open to the atmosphere or vacuum for even faster operation at all times.

The downward activation of seal rods 58 and 60 through piston 62 is achieved, in the illustrated embodiment, through a pneumatic piston 70, driven by air pressure applied at a predetermined moment to chamber 72 of piston cylinder 74 through inlet 76. Orifice 78, in the lower part of piston chamber 74, below piston 70, being open to the atmosphere at all times permits free movement of piston 70.

It will be understood that actuator piston 62 might alternatively be activated by electromagnetic means or any other mechanical means, depending upon the requirements of a particular application for the punch.

It will be appreciated, from the preceding description, that the punch device according to the present invention may be manufactured to very critical tolerances. The device is easy to manufacture. It is, by itself, supportive of all its components and, moreover, permits the ejection of slugs to a remote convenient location without any extra pneumatic, electronic or mechanical accessories.

Thus it is apparent that there has been provided in accordance with the invention a pneumatic punch assembly that fully satisfies the objects, aims and advantages set forth above. While the invention has been described in conjunction with the specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A pneumatic punch for paper comprising:

(a) a cylinder having a chamber;

(b) a piston seated within the cylinder chamber, to be pneumatically driven between upper and lower limits within the chamber;

(c) actuation and retraction air inlet ports through the wall of the cylinder to provide the pneumatic drive of the piston, the ports being separated by the piston against fluid communication within the cylinder chamber between the ports:

(d) an elongated guide of constant, circular cross-section secured centrally to the piston on the side thereof exposed to the air from the retraction air inlet port;

(e) an elongated punch of circular cross-section concentrically secured to the free end of the guide;

(f) a central relatively restricted air passageway from the actuation air inlet side of the piston, extending through the piston, guide and punch;

(g) a die cooperating with the punch, having a body rigidly associated with the cylinder and centrally receiving the guide, and having a slot of circular cross-section to receive the punch;

(h) a space being provided between the punch, when the piston is at its upper limit, and the entrance to the slot of the die to receive and permit passage of paper to be punched;

whereby, during an operation cycle, air pressure introduced through the actuation air inlet port drives the piston to its lower limit and air is passed through the central air passageway of the piston, guide and punch to force a slug of punched paper on through the slot, that air pressure is then removed, and air pressure is introduced through the retraction air inlet port to force the piston to its upper limit, said punch having associated therewith an air valve, the air valve having a chamber which communicates through valve means with a pressure inlet port, the actuation air inlet port also communicating through another valve means with the pressure inlet port, these two valve means cooperating with each other to enable flow of air pressure to either valve chamber or punch cylinder chamber through the actuation air inlet port while sealing off flow of air pressure to the other; the air valve chamber communicating through further valve means with a pressure exhaust port, a further pressure exhaust port being provided in the punch cylinder chamber on the same side of the piston as the actuation air inlet, this punch cylinder chamber pressure exhaust port communicating through valve means with the air valve chamber pressure exhaust port, these latter mentioned valve means cooperating to enable exhaust of air pressure from either the air valve chamber or the punch cylinder chamber while sealing off the exhaust of air pressure from the other, the operation of these valve means being coordinated with that of the first two mentioned valve means to ensure sealing of the relevant exhaust ports when air pressure is flowing to the respective chambers, the retraction air inlet port of the punch cylinder chamber communicating directly with the air valve chamber, whereby pressurizing of the air valve chamber pressurizes the punch cylinder chamber on the retraction air inlet port side of the piston, and exhausting the pressure from the air valve chamber exhausts the pressure from the punch cylinder chamber on the retraction air inlet port side of the piston.

2. A punch according to claim 1 wherein the valve means are pneumatically actuated.

3. A punch according to claim 1 wherein the body of the air valve is integrally associated with the cylinder.

* * * * *